United States Patent [19]

La Fleur

[11] 4,157,103

[45] Jun. 5, 1979

[54] CONTAINER

[76] Inventor: George H. La Fleur, P.O. Box 8, Clarkson, Ontario, Canada

[21] Appl. No.: 855,363

[22] Filed: Nov. 28, 1977

[51] Int. Cl.[2] ..... B65B 3/04; B65B 39/00

[52] U.S. Cl. ..... 141/98; 141/338; 150/0.5; 150/12; 222/527; 224/46 R

[58] Field of Search ..... 16/110.5, 114 R; 150/0.5, 12, 33; 220/94 R; 222/527, 538; 224/46 R, 5 W, 47, 45 R; 141/2, 18, 84, 98, 108, 109, 114, 313, 337, 338

[56] References Cited

U.S. PATENT DOCUMENTS 2,725,087 11/1955 Potter ..... 150/0.5

FOREIGN PATENT DOCUMENTS 1510120 12/1966 France ..... 150/33
631370 11/1949 United Kingdom ..... 222/527

*Primary Examiner*—Richard E. Aegerter
*Assistant Examiner*—Frederick R. Schmidt
*Attorney, Agent, or Firm*—Browdy and Neimark

[57] ABSTRACT

A container molded in full capacity configuration and which is collapsible accordian-fashion to a storage configuration.

8 Claims, 6 Drawing Figures

CONTAINER

The present invention relates to a container, and to a container molded from plastics material which may be collapsed accordian-fashion to facilitate storage, and which has a molded top portion of concave or convex configuration to facilitate filling and emptying.

DISCUSSION OF PRIOR ART

It is obten convenient for motorists to carry with them a container for various purposes but the containers which are usually available and which have a capacity in the order of 1 to 5 gallons are either of metal construction or are manufactured of rigid plastics material and require a relatively large area for storage. As a result, a motorist often does not bother to carry such a container even though times do arise when a container is immportant, such as for example, when out of gasoline or for radiator replenishment, or other purposes.

Also, in these times of increasing costs many motorists tend to their own automobile maintenance and this involves changing the crankcase oil and to accomplish this it is necessary to catch the used oil in a container. The container of the present invention is well suited for this purpose for the top surface of the container is provided with a concave configuration having a central opening so that the container acts both to hold the oil and also as a funnel to direct oil through the central opening and into the container.

SUMMARY OF THE INVENTION

The object of the invention is to provide a container which is collapsible for storage purposes, but which may be enlarged accordian fashion.

The container according to the invention is molded from plastics material in extended full-capacity configuration and is adapted to be collapsed accordian-fashion for storage. The container has a bottom portion and a top portion and an intermediate pleated portion which enables movement of the top portion relative to the bottom portion to vary the capacity of the container itself, and in the completely collapsed portion the container has minimum size to facilitate storage.

It is a further object of the invention to provide a container which may be collapsed accordian-fashion for storage purposes and which may be configured to hold when full varying volumes of liquids.

These objects are attained by the present invention which specifically relates to a container molded from plastics material in extended full-capacity configuration and adapted to be collapsed accordian-fashion for storage, the container having a bottom portion and a top portion and an intermediate pleated portion, and diametrically opposite protuberances or buttons provided on side surfaces of the top portion, and a strap or handle member secured to the bottom portion at at least one point of securement and providing a strap or handle loop, and a first aperture provided in each loop arm an equal distance from the point of securement to receive the protuberance or buttons provided on the top portion in container-carrying configuration, and a second aperture in each loop arm between the point of securement and the first aperture to receive the protuberances or buttons provided on the top portion when the container is collapsed accordian-fashion in storage configuration.

BRIEF DESCRIPTION OF DRAWINGS

These and other features of the present invention will become apparent from the following description taken in conjunction with the accompanying drawings, and wherein.

DETAILED DESCRIPTION OF THE DRAWINGS

Figure 1:
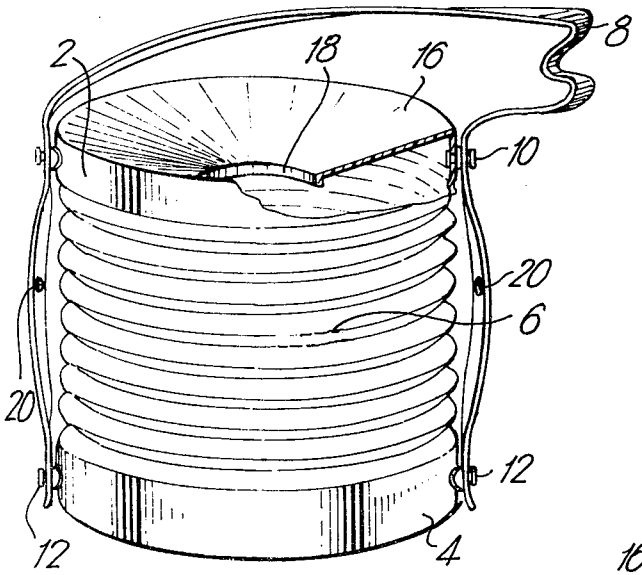
FIG. 1 illustrates one embodiment of the invention in perspective view.
Figure 2:
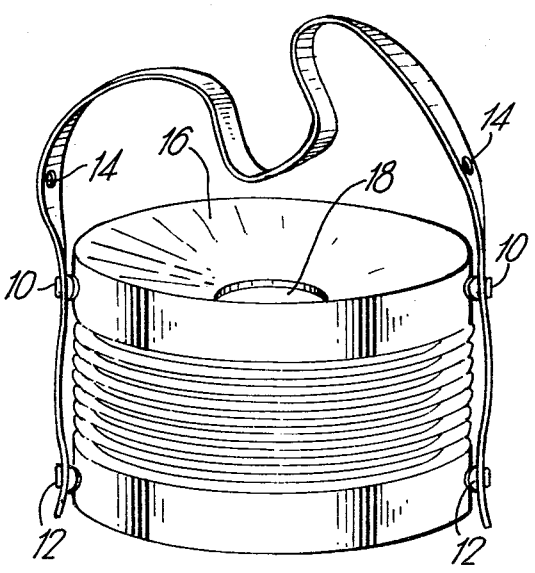
FIG. 2 illustrates the embodiment of the invention as shown in FIG. 1, but shown in compressed or storage position.

FIG. 1 shows the container of the invention in its molded form, having top 2 and bottom 4 portions and an intermediate pleated portion 6 which enables the container to be collapsed accordian-fashion from the full capacity position shown in FIG. 1 to the compressed or storage position as shown in FIG. 2.

Figure 3:
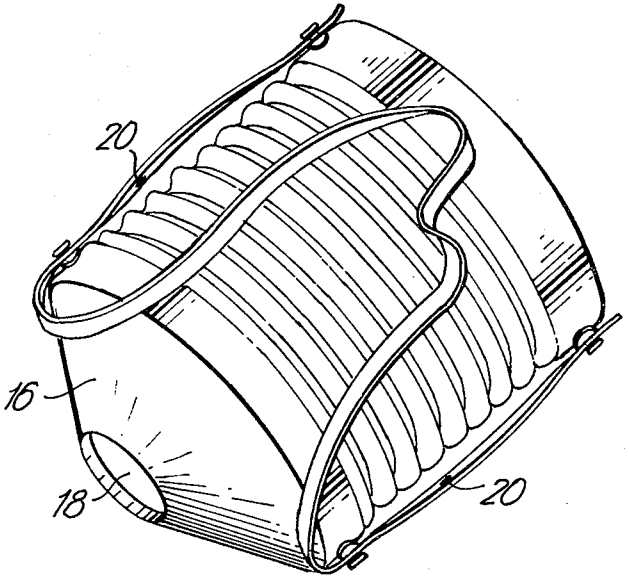
FIG. 3 illustrates the container in pouring position showing the top surface of the container in flexed convex configuration.
Figure 4:
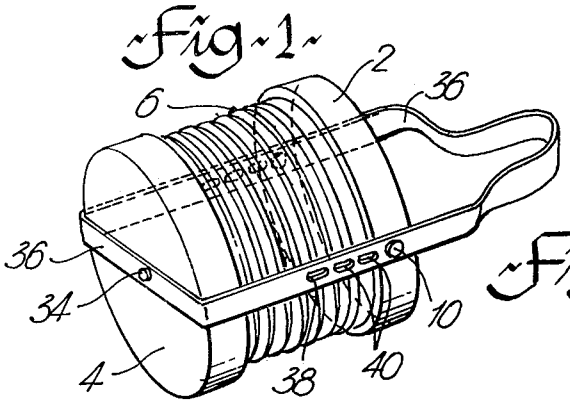
FIG. 4 illustrates in smaller scale and in bottom perspective view a further embodiment of the inventive concept.

The container is molded in the configuration shown in FIGS. 1, 3, and 4, and the container will assume this configuration unless it is purposefully compressed accordian-fashion to the position shown in FIG. 2, and maintained in the compressed condition.

Numeral 8 in FIG. 1 illustrates a flexible strap which has the dual function of providing a carrying handle as well as providing suitable and convenient means for maintaining the container in the collapsed position as shown in FIG. 2.

In the embodiment of the invention as shown in FIGS. 1, 2, and 3, diametrically opposite protuberances or buttons 10 are secured to the top portion 2, and similarly diametrically opposite protuberances or buttons 12 are molded to the bottom portion 4. The buttons 10 and 12 may conveniently be integrally molded with the container body, or alternatively, they may be separately produced and then secured to the container body.

The strap 8 is provided with apertures (not numbered) adjacent its two ends and these apertures provide means for securing the ends of the strap to the protuberances or buttons 12 as clearly shown in FIGS. 1, 2 and 3.

At equal distances from the ends of the strap first apertures 14 (see FIG. 2) are provided in each strap arm and these apertures are adapted to receive the protuberances or buttons 10 provided on the top portion 2 when the container is in the full capacity position as shown in FIG. 1. When the strap is arranged on the container as shown in FIG. 1, a positive carrying strap is provided. The strap also provides for ease of pouring and can be used as a handle during pouring as shown in FIG. 3.

The top surface 16 of the container may be molded in the concave configuration shown in FIGS. 1 or 2 or alternatively in a convex configuration, and in either case the top is provided with a central opening 18. In FIG. 1, the surface 16 is molded in concave configuration and is shown as being generally conical in configuration, but other configurations such as pyramidal are possible, depending on the configuration of the container in plan view which may be four-sided, or poly-sided as desired.

When the top surface 16 is molded in a concave shape it will retain its concave configuration as a result of the original molding, but can flex to the convex configuration as shown in FIG. 3 as a result of interior pressure thereagainst and the convex flexing will occur when liquid is in the container and the container is inverted to the pouring position as shown in FIG. 3. When the container is inverted, the weight of the liquid in the container will flex the top surface to the conical convex configuration shown in FIG. 3, to provide for ease and direction of pouring.

When the container is molded the top surface 16 may have the convex configuration as shown in FIG. 3. When the container is to receive liquids the top can be inverted or "snapped" to the concave configuration as shown in FIGS. 1 and 2 and because of the conical configuration and resiliency of the plastic material from which the container is molded it will retain the concave configuration until returned to its original convex shape.

FIGS. 1 and 3 show the provision of a second aperture 20 provided in each strap arm between the apertures 14 and the ends of the strap. The apertures 20 are provided to hold the container in its compressed or storage position as shown in FIG. 2. To collapse the container from the position shown in FIG. 1 to the position shown in FIG. 2, the strap is simply removed from the protuberances or buttoms 10 and the top 2 and bottom 4 of the container are moved together to the position shown in FIG. 2 and the apertures 20 are then fastened on the protuberances or bottons 10.

Figure 5:
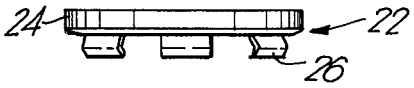
FIGS. 5 and 6 illustrate caps which may advantageously be used with the container of the invention.
Figure 6:
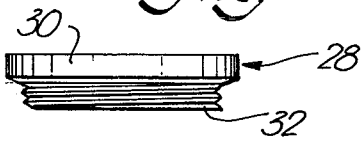

The container as shown in FIGS. 1, 2, and 3 is provided with a central opening 18 which preferably merges smoothly with the concave surface to facilitate filling. The central opening can, if desired, be provided with caps such as shown in FIGS. 5 and 6. The cap 22 shown in FIG. 5 has a central closure portion 24 and downwardly and somewhat outwardly biased lug or flanges 26 which resiliently engage the inner sides of the central opening 18. Alternatively, the sides of the central opening 18 could be provided with molded threading (not shown) to receive a cap such as shown at 28 in FIG. 6, which is provided with threading to engage with the threading provided within the central opening 18.

A further embodiment of the inventive container is shown in FIG. 4, with the top 2 and bottom 4 portions of the container and intermediate pleated portion 6 being as described above with respect to FIGS. 1, 2, and 3. The top portion 4 is also provided with the diametrically opposite protuberances or buttons 10 as discussed above.

In the embodiment illustrated in FIG. 4, however, only a single protuberance or button 34 is provided, and this is centrally on the bottom surface of the bottom portion 4. The protuberances 34 may be recessed somewhat within the bottom surface to provide a flatter surface upon which the container may rest.

The protuberance 34 is adapted to be received within an aperture (not numbered) provided in handle member 36 and which serves the same purpose as the strap member 8 discussed above with respect to FIGS. 1, 2, and 3.

The protrusions 10 provided on the top portion 2 engage in apertures (not numbered) provided in the handle portion 36 so that the loop portion functions as both a carrying handle and a pouring assist for the container as shown in FIG. 4.

When it is desired to collapse the container, the handle member is removed from the buttons 10 and the container is collapsed to the position shown in FIG. 2, and the buttons 10 are then engaged in apertures 38 provided in the handle member as shown in FIG. 4.

By providing a series of apertures along the strap 8 or handle member 36 as shown by apertures 40 in FIG. 4, it is possible to change the volume of the container to hold varying quantities of liquid. If desired, the strap 8 or handle 36 could be marked to indicate the capacity of the container depending upon the aperture selected to be received by protrusions or buttons 10.

I claim:

1. A container molded from plastics material in extended full-capacity configuration and adapted to be collapsed accordian-fashion for storage, the container having a bottom portion and a top portion and an intermediate pleated portion, and diametrically opposite buttons provided on side surfaces of said top portion, a flexible handle member secured to said bottom portion by securing means at at least one point of securement and providing a handle loop, said handle loop having portions extending upwardly from said bottom portion along opposite sides of the container adjacent the said diametrically opposite buttons, a first aperture provided in each said handle loop portions an equal distance from said at least one point of securement to receive said buttons provided on said top portion in container-carrying configuration, and a second aperture in each loop arm between said at least one point of securement and said first aperture to receive said buttons provided on said top portion when the container is collapsed accordian-fashion in storage configuration;

and wherein the container includes a flexible top surface having an opening therein to facilitate filling of, and pouring from, the container.

2. A container according to claim 1, wherein said at least one point of securement is a bottom button provided centrally on a bottom surface of said bottom portion, a further aperture being provided in said handle loop receiving said bottom button.

3. A container according to claim 1, including diametrically opposite bottom buttons provided on side surfaces of said bottom portion, which receive apertures provided in said handle loop to provide points of securement for said handle loop to said bottom portion.

4. A container according to claim 1, wherein the container top surface is molded as a concave surface having said opening therein to facilitate filling, said top surface being flexible to convex configuration during inversion of the container to facilitate pouring from the container.

5. A container according to claim 4, wherein said concave surface is of conical configuration.

6. A container according to claim 1, wherein said top surface is molded as a convex surface having said opening therein to facilitate pouring, said top surface being flexible to concave configuration to facilitate filling of the container.

7. A container according to claim 6, wherein said convex top surface is in conical configuration.

8. A container according to claim 1, including a series of apertures provided in said handle portions between said first and second apertures to selectively receive said buttons on said top portion to hold the container in an intermediate collapsed position.

* * * * *